United States Patent [19]

Sherwood et al.

[11] 4,243,498

[45] Jan. 6, 1981

[54] NICKEL ELECTROWINNING USING REDUCED NICKEL OXIDE AS A FLUIDIZED CATHODE

[75] Inventors: William G. Sherwood, Golden; Donald R. Hodges, Denver, both of Colo.; Cvetko Nikolic, Harvey, La.

[73] Assignee: Amax Inc., Greenwich, Conn.

[21] Appl. No.: 12,777

[22] Filed: Feb. 16, 1979

Related U.S. Application Data

[63] Continuation-in-part of Ser. No. 12,778, Feb. 16, 1979.

[51] Int. Cl.[3] ..... C25C 1/08

[52] U.S. Cl. ..... 204/112; 204/222; 204/291

[58] Field of Search ..... 204/112, 222, 291

[56] References Cited

U.S. PATENT DOCUMENTS

| | | | |
|---|---|---|---|
| 3,703,446 | 11/1972 | Haycock et al. | 204/222 |
| 3,941,669 | 3/1976 | Bharucha et al. | 204/222 |
| 3,974,049 | 8/1976 | James et al. | 204/222 |
| 3,988,221 | 10/1976 | Garrett et al. | 204/222 |
| 4,035,278 | 7/1977 | Wilkinson et al. | 204/222 |
| 4,073,702 | 2/1978 | Fleichmann et al. | 204/222 |

*Primary Examiner*—R. L. Andrews

*Attorney, Agent, or Firm*—Michael A. Ciomek; Eugene J. Kalil

[57] ABSTRACT

A fluid bed electrolysis process is provided for the recovery of nickel from nickel-containing solution, e.g., leach solution, in which a fluid bed of substantially pure nickel particles or pellets of size ranging from about 150 to 2000 microns is employed, the fluid bed being preferably formed of reduced nickel oxide, such as hydrogen-reduced nickel oxide.

21 Claims, 13 Drawing Figures

NICKEL ELECTROWINNING USING REDUCED NICKEL OXIDE AS A FLUIDIZED CATHODE

RELATED APPLICATION

This application is a continuation-in-part of application Serial No. 12,778, filed Feb. 16, 1979, the disclosure of which is incorporated herein by reference.

This invention relates to a fluid bed electrolysis process for the electrowinning of nickel from nickel-containing electrolytes using nickel particles or pellets, e.g., reduced nickel oxide pellets, as a fluidized cathode.

BACKGROUND OF THE INVENTION

The use of electrochemical processes in extractive metallurgy is constantly growing because of the relative stability of electrical energy costs and an increasing application of hydro-metallurgical processes for environmental reasons. Electrowinning and electro-refining processes using plate electrodes have been in operation for many decades. However, such processes suffer from capacity limitations. The cell production capacity per unit volume is limited not only by the chemical problems of polarization and the nature of the cathode deposit, but also by the practical problem of electrode surface area per cell unit volume.

Recently, considerable interest has been focused on electrolytic systems using particles that can act either as an extension of the electrode with which they are in contact or behave as an electrode independently, thus achieving a large increase in electrode area per unit cell volume.

One type of electrode is that referred to in the art as a fluid bed electrode (FBE). The term comes from the observation that when a bed of electrically conductive material is fluidized by an upward flow of electrolyte, the bed can be made to function as an electrode by inserting a conductor in the bed (e.g., a cathode) through which an electric current is passed. It is known to employ agitated bed electrodes where the particles are kept in suspension by stirring or by suspension electrodes where the particles are agitated by a vibrating plate or diaphragm. Static beds have been employed; however, such beds tend to cement together during metal deposition and lose their efficiencies.

A fluid bed electrode process that has been proposed is one using a cell having a plane parallel configuration comprising a bed of electrically conductive particulate material with an anode disposed above it, the bed being supported on a porous support. In this configuration, the electrolyte is passed through the porous bed support and flows out of the cell at the top. The current feeder for the cathode is located in the bed and is perpendicular to the flow direction of the electrolyte. The flow of current in this type cell is parallel to electrolyte flow. A disadvantage of this process using fine nickel powder of about 90 microns average size as the fluidized cathode is the tendency for the nickel particles to float due to hydrogen gas evolution on the surface of the particles which carries the particles to the anode surface, thus causing a change in the position of the anode relative to the bed. The over-expansion of the bed also tended to adversely affect the electro-chemical properties of the fluid bed. In the parallel cell configuration, it was difficult to maintain a uniform flow distribution of the electrolyte because of the large cross-sectional area to height ratio of the bed.

Even when the fluidization of the cathode bed was satisfactory, plating tended to occur preferentially on the bed surface facing the anode. Because the cathode feeder was disposed at the bottom, bed heights of only a few centimeters could be tolerated.

Side-by-side electrodes have been proposed comprising a fluid bed electrode with a second electrode inserted into the bed, the second electrode being coated with an insulating material, e.g., polypropylene, of sufficient porosity to provide current flow while avoiding shorting of the cell. Various embodiments of side-by-side electrodes are disclosed in the literature.

In an article entitled "A Preliminary Investigation of Fluidized Bed Electrodes" by J. R. Backhurst et al (Journal of the Electrochemical Society [Electrochemical Technology]; November, 1969, pp. 1600–1607), a cell with a side-by-side electrode is disclosed for use in the cathodic reduction of the organic compound nitro benzene sulfonic acid to metanilic acid in aqueous sulfuric acid, a typical cell comprising a cathode bed of copper powder in a cathode chamber isolated by a porous diaphragm which in turn is surrounded by an annular anode (e.g., a lead anode) to provide a cell having a concentric configuration. In cathodically reducing the organic compound, copper-coated glass particles of 450 to 520 micron size were employed, the fluidized bed volume ranging from about 5% to 25% greater than the static bed volume.

In a paper entitled "Feasibility Study On The Electrowinning of Copper With Fluidized-Bed Electrodes" by J. A. E. Wilkinson et al (Institute of Mining and Metallurgy [London]; September 1972, Vol. 81, pp. C157–C162), a fluidized-bed electrode is disclosed for the electrowinning of copper from leach liquors and other solutions. A side-by-side configuration proposed comprised anode and cathode compartments separated by a non-porous ion exchange membrane, the cathode comprising the fluidized bed. The results indicated that copper could be deposited from dilute solutions.

Another paper of interest is one entitled "The Fluidized Bed in Extractive Metallurgy" by D. S. Flett (Chemistry and Industry; Dec. 16, 1972, #24, pp. 983–988). In this paper, a side-by-side electrode configuration is disclosed comprising a vertical cell in which a fluidized bed is supported vertically on one side of the cell by a membrane and in which a vertically disposed anode is spaced to one side of the membrane-supported fluid bed. The electrolyte is fed from a leach circuit to the fluidized cathode cell for the recovery of metal values therefrom.

A number of cell configurations are considered in the paper entitled "Feasibility Study On The Electrowinning of Copper With Fluidized-Bed Electrodes" by J.A. E. Wilkinson et al (Institute of Mining and Metallurgy [London]; Vol. 82, pp. C119–C125, 1973). One arrangement comprises a side-by-side electrode configuration formed of concentric anode and cathode compartments. In this configuration, the cathode feeder which is tubular is embedded in the bed such that part of the bed is shielded from the anode which is not desirable. Other cell configurations are disclosed in U.S. Pat. Nos. 3,941,669, 3,951,773 and 3,988,221.

A problem encountered in fluid bed electrolysis is the formation of gas bubbles during electrolysis (e.g., the formation of oxygen at the anode in the anode chamber and the formation of hydrogen at the cathode in the cathode chamber) which can have an adverse effect on the fluid bed process unless the gases are removed during circulation of the electrolyte. For example, the rapid release of oxygen in the anode chamber may be sufficient to force the electrolyte out of the anode chamber and adversely affect the efficiency of the cell.

Cell efficiency is important in the electrowinning of nickel from nickel-containing solutions, for example, nickel solutions obtained in the hydro-metallurgical treatment of nickel ore (e.g., nickel lateritic ore) or nickel sulfide material, such as nickel and/or nickel-copper mattes. There is a need for a process for recovering substantially pure nickel from laterite leach solutions, such as leach solutions containing less than about 10 grams per liter (gpl) of nickel and up to about 1 gpl cobalt. It would also be desirable to recover nickel from leach solutions of higher nickel concentration, such as those obtained in the leaching of nickeliferous sulfide materials.

An example of nickel-containing leach solutions obtained in the leaching of laterite ores is given in U.S. Pat. No. 4,097,575. Another example of nickel-containing leach solutions obtained in the leaching of nickel-copper sulfide materials is illustrated in U.S. Pat. No. 4,093,526.

The purity of nickel recovered from nickel leach solutions may depend on the fluid bed cathode employed as the substrate for receiving the nickel deposite. We have found that particles or pellets of reduced nickel oxide provide an excellent substrate upon which to deposit nickel and produce a final nickel produce of fairly high purity.

OBJECTS OF THE INVENTION

It is an object of the invention to provide an improved fluid bed electrolysis process for the recovery of nickel from nickel-containing electrolytes.

A further object is to provide an improved fluid bed electrolysis process for recovering nickel from solutions using a fluid bed of reduced nickel oxide.

These and other objects will more clearly appear from the following disclosure and the accompanying drawing.

THE DRAWINGS

STATEMENT OF THE INVENTION

The advantages of using fluid bed electrolysis for the electrowinning of nickel from nickel-containing solutions using reduced nickel oxide pellets as the fluid bed are as follows: (1) low current densities at high current throughput per unit cell volume; (2) reduction of nickel content to very low concentrations; and (3) the additional advantage of producing a saleable product of substantially high purity nickel.

The reduced nickel oxide is easily prepared and can be advantageously produced by hydrogen reduction of nickel oxide pellets of a predetermined size range. The nickel oxide pellets may be advantageously produced by burning nickel chloride solution in a fluid bed hydrolyzer and the pellets thereafter hydrogen reduced at about 650° C. Of course, other methods of reducing nickel oxide pellets may be employed.

The reduced nickel oxide contains over 95% nickel and generally contains at least about 98% nickel, for example, 99% nickel and higher.

The particle size of the reduced nickel oxide may range from about 150 to 2000 microns and generally from about 300 to 1200 microns, for example, 500 to 1000 microns.

The final product produced will have a purity at least as good as the purity of the reduced nickel oxide.

In carrying the process of the invention into practice, a fluid bed electrolysis cell is employed comprising an axially disposed anode surrounded by a cathode, the anode being separated by an anode chamber from the cathode by a partition in the form of a porous diaphragm. The anode chamber is surrounded by an annular cathode chamber, the annular cathode chamber being adapted to support a fluidizable cathode bed of nickel pellets, the particle size of the pellets being less than the size of openings in the anode diaphragm. The cell system employed has means for continuously feeding nickel electrolyte into the cathode and anode chambers. The feed rate of the electrolyte is controlled to maintain the bed of particulate material in an electrochemically active fluidized state and to assure removal of electrolytically produced gas bubbles. In other words, the bed must not be so fluidized that the particles thereof lose their cathodic coupling with the cathode surrounding the bed.

An advantage of the foregoing system is that nickel can be removed from fairly dilute solutions. Another advantage is that cobalt can be separated from nickel in the presence of high nickel concentrations over a wide range of electrolyte compositions and the remaining nickel then recovered in substantially the pure state. The plating can be achieved in nickel laterite leach solutions, despite the unfavorable nickel to hydrogen ion concentration ratio.

Figure 1:
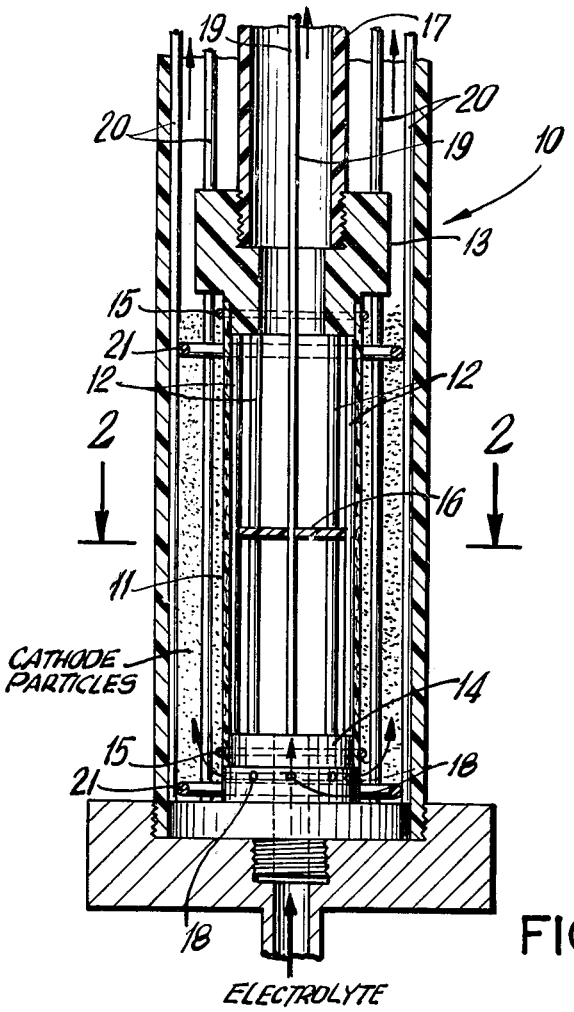
FIG. 1 is one embodiment of a fluid bed cell which may be employed to carry out the process of the invention.
Figure 2:
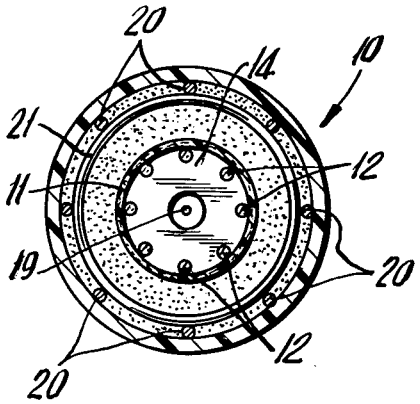
FIG. 2 is a cross-section of FIG. 1 taken along line 2—2.

One embodiment of a fluid bed electrolysis cell is shown in FIG. 1. The cell 10 is divided into two concentric compartments (an anode chamber and an annular cathode chamber) separated by a fairly rigid porous polypropylene diaphragm 11. The diaphragm is supported by eight ⅛" diameter vertical glass rods 12 (FIG. 2) between an upper anode compartment adaptor 13 and the flow distribution block 14. The diaphragm is a cylindrical tube secured at each end with a neoprene O'ring 15 and a nylon fastener. The small diameter of the glass rods maximizes the exposed anode-cathode interface per unit bed height, increasing the active interfacial area by a factor of 5 over that available with a previously used perforated PVC tube diaphragm support. The anode height (and therefore, the active bed height) is easily varied with the glass-rod system. Horizontal plexiglass supports 16 prevents the membrane from collapsing and prevents the associated localized high current densities that produce dendritic growth through the membrane.

The upper anode compartment adaptor 13 is threaded to accept a non-porous one inch threaded PVC tube 17 that directs flow to the top of the cell. The anolyte exits through a screened hole in the upper portion of the tube and is recombined with the recirculating electrolyte.

Electrolyte enters the cell through the center of flow distribution block 14 and is directed into the particulate bed through eight evenly spaced (⅛" diameter) horizontal passages 18. The distributor block can be modified to provide preferential flow upward through the anode compartment. This provision is preferred to obtain higher currents where only minimal electrolyte flow is necessary to sustain proper bed fluidization. In the absence of preferential anode compartment flow, at low flow rates or high absolute current values, anolyte may be completely displaced from the anode compartment by oxygen produced at the anode surface, and cell resistance is markedly increased.

The recirculating electrolyte exits from the interior cell body into a concentric overflow basin (note FIG. 4), where gas bubble disengagement occurs. A meshed weir around the center cell body further enhances gas segregation and prevents particles attached to evolved gas bubbles from exiting the cell. This feature is essential to prevent chemical dissolution of deposited metals from the bed particles, in the absence of cathodic protection. Alternatively, a series of similar cells can be used to avoid the necessity for recirculating within a cell.

The anode materials employed were lead-silver or lead-calcium alloys extruded into ¼" diameter rods. The rod 19 is positioned centrally on the flow distributor block, and extends vertically and axially through the diaphragmed anode compartment, where it is centered with horizontal plexiglass supports 16. The rod continues through the PVC tube, and the power supply connection is made at the top of the cell (not shown).

The cathode current feeder 20 consists of eight ⅛" diameter copper tubes soldered to two 2½" diameter copper rings 21 at the top and bottom of the feeder assembly. The height of this portion of the feeders is the same as that of the exposed anode height and the expanded (fluidized) bed height. Two of the feeder tubes extend out of the top of the cell where the power supply connection is made. The extended tubes are electrochemically and chemically shielded with tight-fitting tygon tubing.

Figure 3:
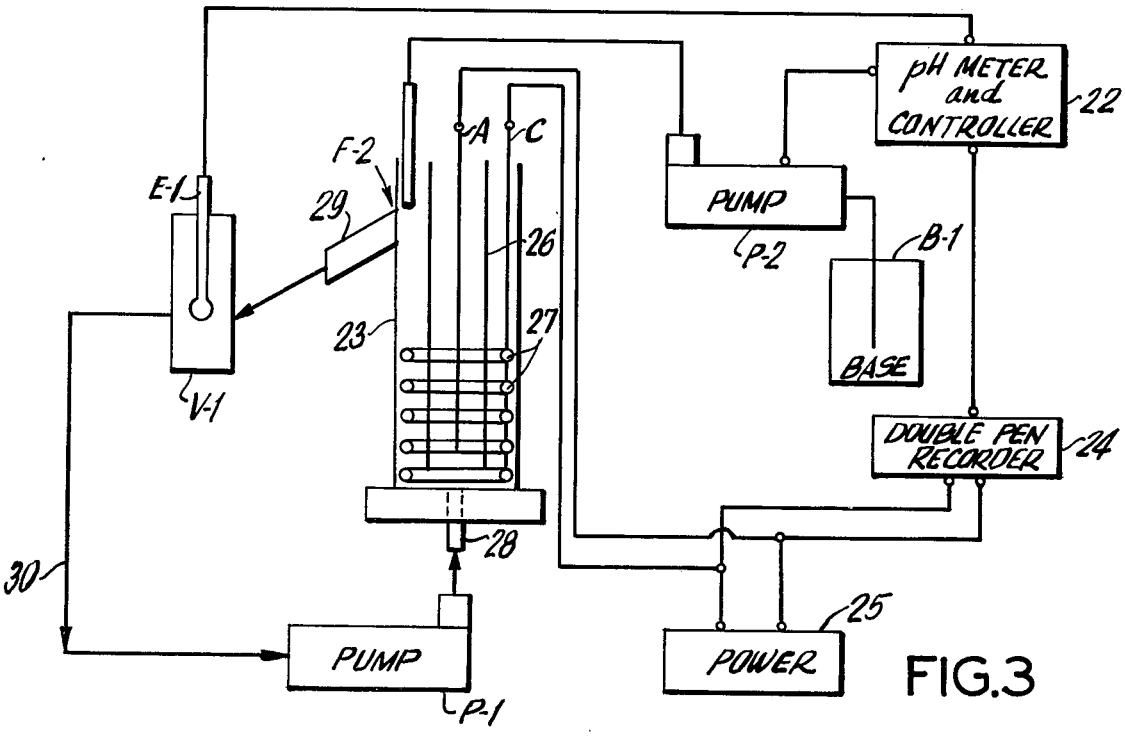
FIG. 3 is one embodiment of a fluid bed electrolysis system for carrying out the process of the invention.

A fluid system for carrying out the process on a continuous basis is shown in FIG. 3.

Referring to FIG. 3 pump P-1 which has a flow capacity of 8 liters/minute, is used for electrolyte circulation. A pH probe E-1 is provided. Vessel V-1 isolates the pH probe (E-1) from the electric field in the cell and, moreover, promotes mixing of the electrolyte and the base (B-1) used for pH control. The base may advantageously be a slurry of magnesium hydroxide. Probe E-1 provides input to the pH meter and controller 22 to feed base from pump P-2 into the electrolyte at point F-2 of cell 23. The pH value is recorded using one channel of a double pen recorder 24. The second channel records the cell voltage, measured across the power supply 25, which is operated at constant current. The cell contains sufficient nickel particles (800 microns average size) to provide 2 square meters ($M^2$) of cathode area, and the total circulating electrolyte volume is 1.2 to 1.5 liters. The foregoing cathode area provided by the particles corresponds to about 2,375 grams by weight of the bed.

Anode feeder A and cathode feeder C of the cell (supported by means not shown) are coupled across power supply 25 at the proper voltage and current supply. Anode feeder A is surrounded by a porous diaphragm 26 (which defines the anode chamber) which in turn is surrounded by cathode ring members 27.

The electrolyte is fed by means of pump P-1 into cell inlet 28 and leaves at exit 29 of the cell and recirculated via line 30 through pump P-1. The pump may have a pressure-activated transducer means associated therewith for shutting off the pump and power when the pressure falls below a predetermined value. The fluidized bed is maintained substantially within the confines of cathode rings 27 in the annular cathode chamber between the anode chamber and the cathode. The electrolyte free of cathode particles enters the anode chamber through the porous diaphragm.

It is preferred that the porous diaphragm have a large exposed area. The exposed area (the porosity) may range from about 5 to 30% of the total surface area of the diaphragm and, more preferably, range from about 10 to 25% of the total area; so long as the openings are less in size than the average particle size of the cathode particles.

The average particle size of the cathode nickel particles should be over about 150 microns and range up to about 2000 microns. It is preferred that the average particle size of nickel range from about 300 to 1200 microns, e.g., 500 to 1000 microns.

The volume of the cathode bed in the fluidized state (bed expansion) should be that volume which will assure electrochemical activity of the bed to pass current. For example, the volume of the fluidized bed should be at least about 5% greater than the volume of the bed at a state of rest (static volume) and range up to about 20% greater than the static volume, depending upon the average particle size of the nickel particles. The fluidized volume may preferably range from about 8% to 15% greater than the static bed volume.

Uniform fluidization and controlled bed expansion ensure good current efficiency for reducing nickel concentration to low levels (for example, to less than about 100 ppm, e.g., to less than about 10 or 6 ppm).

Figure 7:
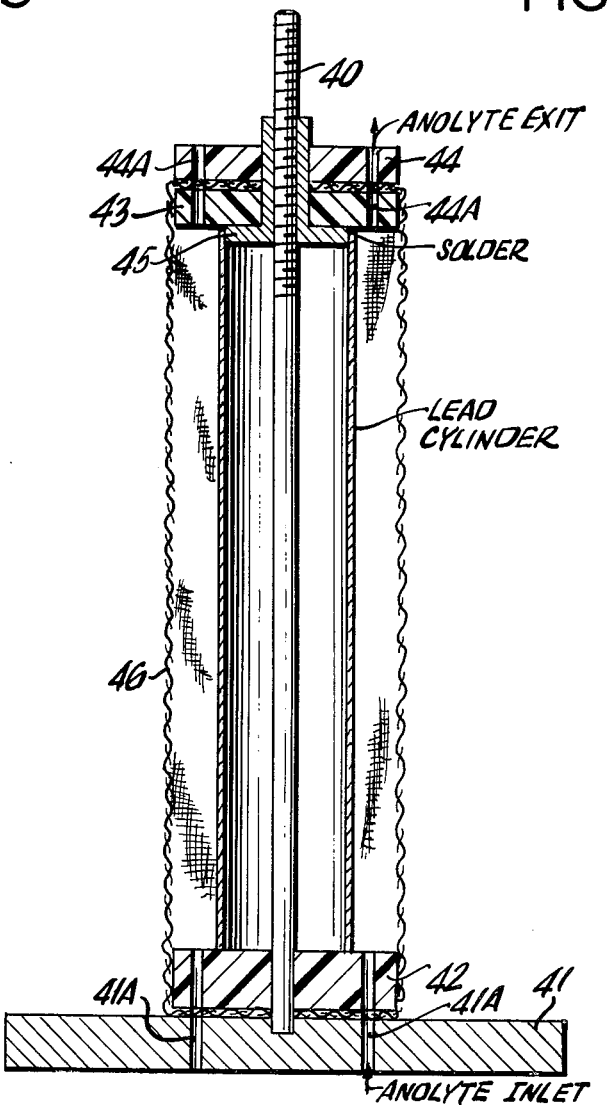
FIG. 7 is an embodiment of an anode surrounded by a porous diaphragm held under tension by tightening means.

Anode chambers are generally made of rigid porous columns (note FIG. 1) rather than from flexible material. The rigid porous material is limited in the amount of porosity it can provide. It is preferred to use a more flexible diaphragm made of tensioned filter cloth. Such a diaphragm is shown in FIG. 7 comprising an anode 40 in the form of a threaded titanium rod attached to a lead cylinder and mounted to flow distribution or deflection plate 41.

The anode 40 is provided with an axially mounted thick Teflon (Registered Trademark) washer 42 fixed at its bottom end and two gripping Teflon washers 43, 44 at its top mounted on a threaded titanium nut or bushing 45, the bushing being threaded to the anode. A sleeve of filter cloth 46 is tension mounted between the upper and lower Teflon washers as shown, washers 43, 44 gripping the end of the sleeve between them, the bottom end of the sleeve being fastened to Teflon washer 42. Tension is applied longitudinally of the sleeve by simply turning the titanium nut or bushing, causing it to move upward along the threaded anode.

The advantage of the foregoing diaphragm is that it provides a flexible anode chamber and also assures high surface exposure of the diaphragm (open spaces) ranging from 5 to 30% of the total area of the diaphragm, more preferably, ranging from about 10 to 25% surface exposure. The tension adjustment for the sleeve permits use of inexpensive filter cloth materials for the diaphragm as opposed to porous ceramic or rigid polymeric material (e.g., PVC) used previously. The use of a filter cloth per se as the diaphragm is shown in the cell of FIG. 4, the tensioning means being omitted for purposes of clarity.

Figure 4:
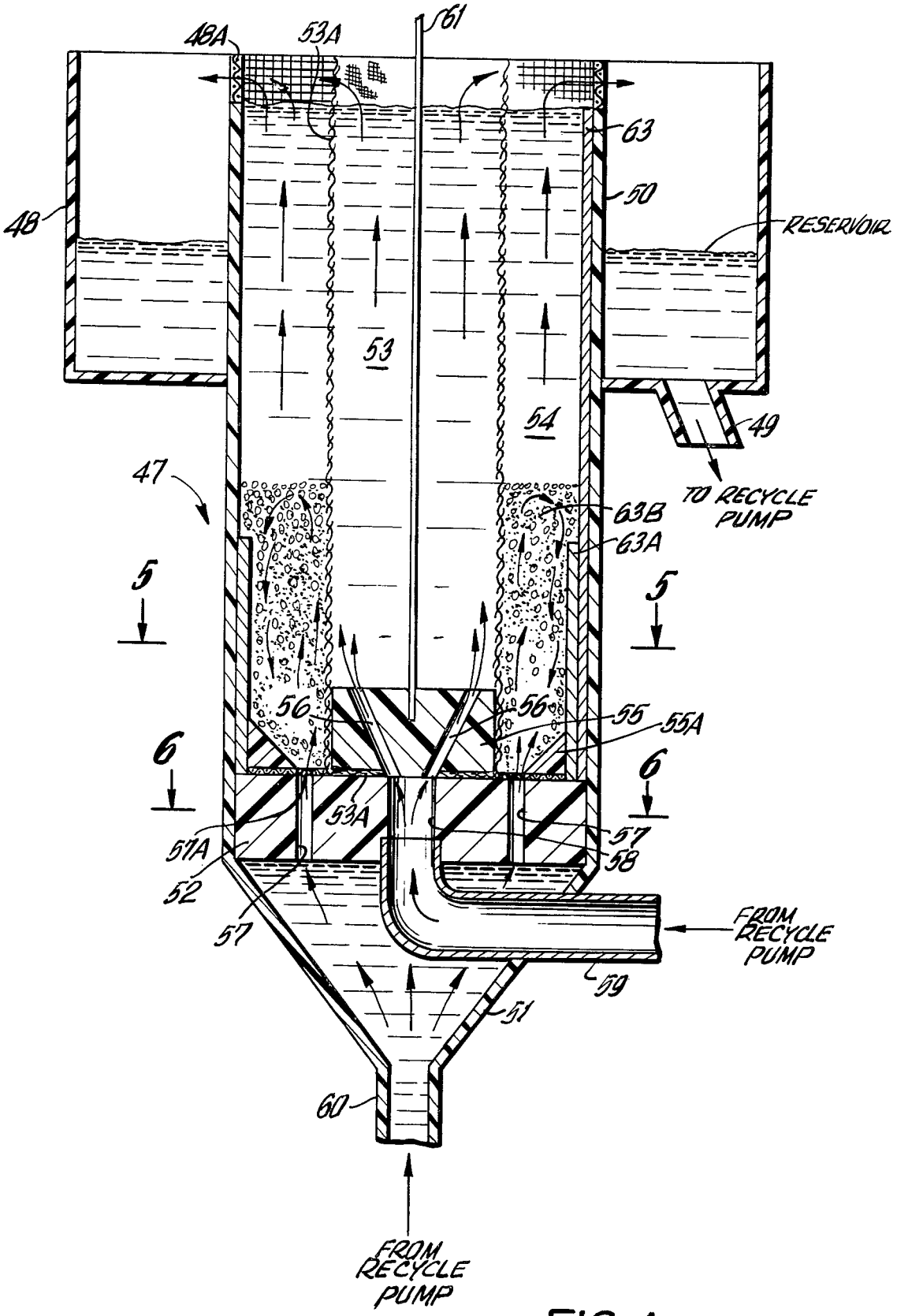
FIG. 4 is another embodiment of a fluid bed cell for carrying out the process of the invention.

The embodiment shown in FIG. 4, illustrates the concept of passing the electrolyte directly through the anode chamber as well as through the annular cathode chamber. This is advantageous as it removes the oxygen which deposits at the anode from the cell during circulation of the electrolyte, which overflows into a basin in which the gas can disengage itself from the solution before recycle.

Referring to FIG. 4, a cell 47 is shown with an overflow dam or basin 48 located at the top thereof into which circulating electrolyte flows for transfer to a recycle pump via exit port 49. An overflow weir 48A in the form of a screen of inert material, e.g., polymeric fibers, such as nylon or polypropylene, is provided at the top of the cell. The cell may be formed of a plexiglass column 50 having a conically shaped bottom or funnel 51 divided from the upper portion of the cell by horizontal partition 52 of plastic, e.g., Teflon. In place of the overflow dam, a solution reservoir may be employed series-connected to the electrolyte flow. Thus, the reservoir can serve as means for disengaging the gas from the solution before recycle.

The cell above the partition is divided into an anode chamber 53 surrounded by porous diaphragm 53A and an annular cathode chamber 54, the anode chamber having an electrolyte distributor plug 55 of non-conductive material, e.g., plastic, such as Teflon, at its bottom with conically arranged distributor holes or ports 56, the plug being axially located relative to partition 52 which in turn has distributor holes or ports 57 arranged in a circle relative to the annular cathode chamber. The ports 57 at the bottom of the cathode chamber are covered by a nylon screen 57A to prevent downward movement of the particles.

A central port 58 is provided in partition 52 for axially feeding electrolyte into anode distributor ports 56, the central port being coupled to electrolyte feed pipe or conduit 59 which receives electrolyte from a recycle pump not shown. The conical bottom 51 in turn has inlet means 60 for receiving electrolyte from the recycle pump for flowing up into the cathode chamber.

A slender anode 61 is shown (suitably supported by means not shown) extending upwardly into the cell from the anode distributor plug 55, the plug being surrounded by a sheath of filter cloth (e.g., woven nylon) in the form of a diaphragm 53A which extends upwardly into the cell and which is held under tension by means not shown similar to the tensioned diaphragm of FIG. 7.

Figure 5:
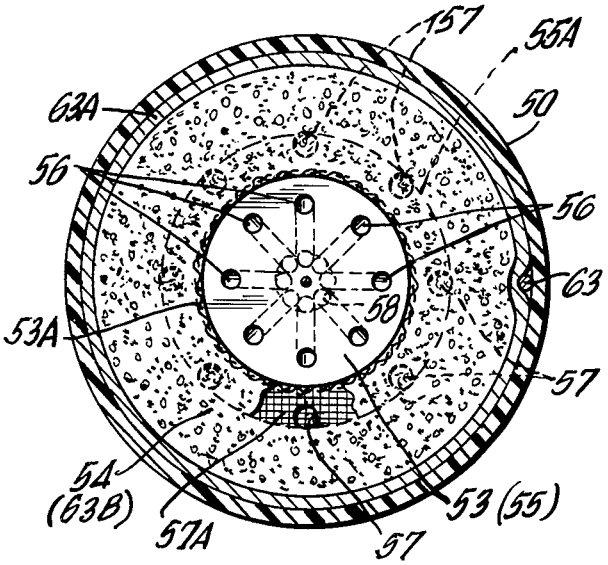
FIG. 5 is a cross-section of the cell of FIG. 4 taken along line 5—5.

A cathode feeder 63 (suitably supported by means not shown) is depicted extending downwardly along the wall of the cell and connected to an annular cathode portion 63A. Thus, an annular cathode chamber is provided between the diaphragm and the annular cathode, the annular chamber being fed with electrolyte through cathode distributor ports 57 arranged in a circle around the annulus of the chamber, as shown in FIG. 5. As will be noted from FIG. 4, the cathode chamber contains a suspension of electrically conductive particles 63B of nickel.

Figure 6:
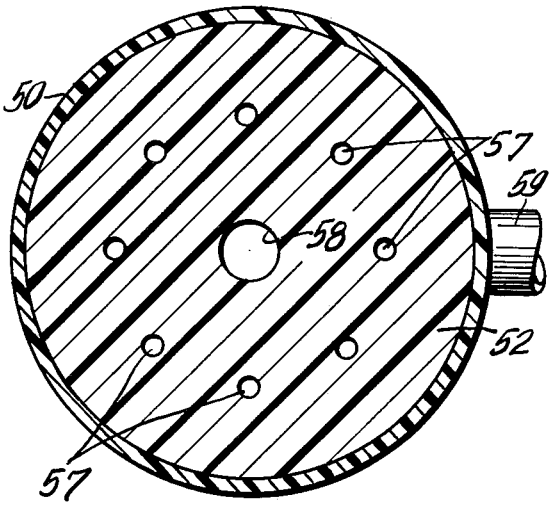
FIG. 6 is a cross-section of the cell of FIG. 4 taken along line 6—6.

FIG. 5 is a cross-section taken along line 5—5 of FIG. 4 showing the cell wall 50, annular cathode 63A, the annular cathode chamber 54 with conductive particles 63B, cathode distributor ports 57, anode distributor ports 56 and the anode segment 62 shown in the center of the cross-section. In FIG. 6 taken along line 6—6 of FIG. 4, the partition 52 is shown within cell wall 50 showing cathode distributor ports 57 arranged in a circle and anode feed port 58 for feeding electrolyte into the distributor ports 56 (FIG. 5) of the anode chamber.

The recycling of the electrolyte to and from the cell will be clearly apparent from the schematic flow sheet of FIG. 3. When the electrolyte containing nickel ions is fed into the bottom of the cell into the cathode chamber as shown in FIG. 4, the cathode bed is caused to fluidize sufficiently to provide bed suspension and circulation of nickel pellets in the cathode chamber as shown, the expansion of the bed under substantially steady state conditions ranging from about 5% to 20% greater than the static volume of the bed.

As illustrative of the various embodiments of the invention, the following examples are given:

EXAMPLE 1

A test was conducted in a 3" diameter cell of the type shown in FIG. 1 with a solution containing 8 gpl $Ni^{+2}$, 60 gpl $Na_2SO_4$, the solution having a pH of about 3.0. Various current loads were employed. To simulate the use of reduced pure nickel oxide, a bed of particles having a pure nickel surface was empolyed to study the plating conditions (nickel-coated copper). The fluid bed contained about 2500 grams of the nickel-coated copper particles or pellets of average size ranging from about 500 to 700 microns (about 25 to 35 mesh, Tyler Screen) which provided a total surface area of approximately 2.8 square meters. The fluid bed electrolysis was carried out at various temperatures for 8 hours. The results are given in Table 1 below.

TABLE 1

| Current Amps | T, °C. | Current Eff. % | Terminal $Ni^{+2}$, gpl |
|---|---|---|---|
| 10 | Max 36 | 18 | 3.8 |
| 10 | 70 | 29 | .076 |
| 20 | Max 45 | 20 | .070 |
| 20 | 70 | 32 | .048 |
| 30 | Max 59 | 33 | .014 |
| 30 | 70 | 36 | .025 |
| 30 | Max 52 | 27 | .078 |
| 35 | Max 69 | 36 | .11 |
| 35 | 70 | 41 | .094 |
| 40 | 70 | 40 | .050 |

180 gpl $Na_2SO_4$

The data in Table 1 indicate that increasing the temperature and the current density results in a significant increase in the current efficiency. The difference in efficiency produced by increasing the temperature at a given current density becomes less as the current density increases. This is an artificial effect in that the maximum temperature of uncontrolled tests increases with increasing current density due to resistive heating. No attempt was made to maintain the same low temperature for various current densities.

Although increasing current density typically results in decreased current efficiency in conventional parallel plate electrowinning cells, the opposite effect is observed here, at least in the current ranges investigated. Polarization measurements suggest that a minimum current density is necessary to insure that a sufficient portion of the particulate bed is at the potential necessary to effect reduction of the metal ion of interest.

The results obtained using substantially pure reduced nickel oxide (about 99.2%+ nickel) as the bed material on dilute nickel solution is given in Example 2 below:

EXAMPLE 2

Tests were also conducted in a 5" diameter cell. The fluid bed comprising reduced nickel oxide was 12" high, the solution containing 4 gpl $Ni^{+2}$, 60 gpl $Na_2SO_4$ and having a pH of 3.0. The reduced nickel oxide ranged in size from about 600 to 1400 microns, the weight being about 25 lbs. (about 11,300 grams). The volume of the solution was 22 liters and the amount of current 125 amps. The particles provided a current density of approximately 7.35 amps/$M^2$. The results obtained are given in Table 2 as follows:

TABLE 2

| Time (min.) | $Ni^{+2}$ (gpl) | Cell Voltage |
|---|---|---|
| 0 | 4 | 9.1 |
| 20 | 3.2 | 9.2 |
| 31 | 2.4 | 9.2 |
| 40 | 1.72 | 9.1 |
| 60 | 0.88 | 9.1 |
| 80 | 0.30 | 9.4 |
| 100 | 0.062 | 9.4 |

The current efficiency at 0.062 gpl Ni was 38%. The power consumption was 10.2 KWH/lb of plated metal.

Another test was conducted using a current flow of 250 amps, a fluid bed height of reduced nickel oxide of 24", and 24 liters of solution containing 13.4 gpl $Ni^{+2}$ and 60 gpl $Na_2SO_4$. The size range of the nickel particles was about the same.

The results obtained are as follows:

TABLE 3

| Time (min.) | $Ni^{+2}$ (gpl) | Cell Voltage |
|---|---|---|
| 0 | 13.4 | 7.9 |
| 27 | 10.4 | 7.9 |
| 45 | 8.8 | 7.8 |
| 60 | 6.8 | 7.8 |
| 75 | 5.0 | 7.9 |
| 90 | 1.76 | 7.95 |
| 108 | 0.82 | 7.8 |

The current efficiency at 0.82 gpl $Ni^{+2}$ was 61% (5.24 KWH/lb. metal plated) and at 1.76 gpl $Ni^{+2}$ about 71% (4.35 KWH/lb. metal plated). The electrolysis was stopped before removing substantially all of the nickel.

EXAMPLE 3

A test was conducted in a 3" diameter cell of the type illustrated in FIG. 1 using 2500 grams of nickel particles (reduced nickel oxide) of size ranging from about 35 to 48 mesh (Tyler Screen), the size corresponding to about 250 to 500 microns. Smaller particle sizes generally require a bed restriction device to prevent particles from leaving the cell. The total surface area of the bed was approximately 4.5 $M^2$. The tests were carried out in 4 liters of solution at a current flow of 35 amps and at a temperature of 70° C., the solution containing 17.8 gpl $Ni^{+2}$ and 60 gpl $Na_2SO_4$ (PH=3.0). The plating was not carried out to completion.

The results are given in Table 4 below:

TABLE 4

| Time | $Ni^{+2}$ (gpl) | Cell Voltage |
|---|---|---|
| 0 | 17.8 | 17.5 |
| 15 | 16.8 | 7.5 |
| 30 | 14.8 | 7.5 |
| 45 | 14.0 | 7.3 |
| 60 | 12.6 | 7.6 |
| 90 | 9.4 | 7.3 |
| 120 | 7.6 | 7.1 |

The current efficiency at 7.6 gpl $Ni^{+2}$ was 52.9%, the power consumed being 5.69 KWH/lb. of metal deposited.

Another advantage of the fluid bed electrolysis process is that relatively pure nickel can be recovered from solutions containing cobalt by first removing the colbalt electrolytically in the fluid bed cell together with some nickel followed by the removal of the remaining nickel in the solution to provide a nickel product containing a nickel to cobalt ratio of at least about 100:1, preferably, at least about 250:1 and, more preferably at least about 500:1, e.g., 1000:1 and higher, the nickel product containing at least about 98% nickel, including cobalt and impurities.

In the following test, particles having a pure nickel surface (nickel-coated copper) were employed to simulate the use of reduced nickel oxide.

EXAMPLE 4

A nickel-containing sulfuric acid solution corresponding to a typical leach solution and containing 54 gpl Ni and 1.2 gpl Co was tested. The fluid bed comprised 2500 grams of nickel-coated copper particles of about 500 to 700 microns in size.

Typical results for Ni/Co separation are shown in Table 5. The pH was controlled in the ranges indicated by the manual addition of 50% NaOH, the maximum pH not exceeding that pH at which nickel hydrolyzes from solution.

TABLE 5

| Time | Ni, gpl | Co, gpl | Ni/Co | i, Amps | pH |
|---|---|---|---|---|---|
| 0 | 54. | 1.2 | 46.8 | — | — |
| 60 | 50. | 0.86 | 58 | 4 | 3-6 |
| 120 | 50. | 0.66 | 76 | 4 | 4-2 |
| 180 | 48. | 0.46 | 104 | 4 | 3-2 |
| 240 | 48. | 0.30 | 160 | 4 | 3-2 |
| 300 | 46. | 0.15 | 307 | 4 | 3.5-2 |
| 330 | 42. | 0.086 | 488 | 8 | 4-2 |
| 365 | 37. | 0.034 | 1088 | 12 | 5-2 |

Figure 8:
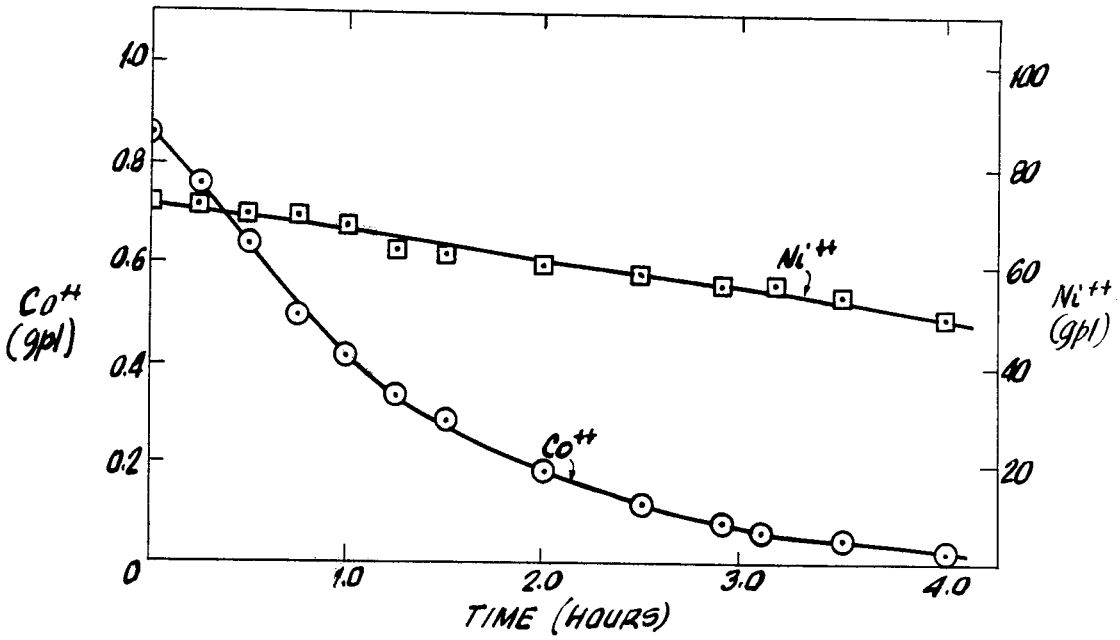
FIG. 8 is a plot depicting nickel/cobalt separation from an ammonia solution.

The net current efficiency during the above test was 45 percent, verifying that Ni and Co can be effectively separated at a fluidized cathode. Although this test was terminated prior to attaining a desired Ni/Co ratio of at least 1500:1, this ratio could have been achieved as evidenced by the results of a subsequent test on a nickel-cobalt ammoniacal solution as illustrated by FIG. 8. The current density for this test was 2.22 $A/M^2$ and the pH was 7.6. The initial electrolyte contained 100 gpl $(NH_4)_2SO_4$(2.2 M $NH_3$/M Ni). The final Ni/Co ratio was 1725. These results indicate that Ni/Co separation can be performed even in highly complexing media such as ammonia.

While removing the cobalt from solution, the solution is monitored colorimetrically for cobalt until the desired minimum level of cobalt in solution is reached. The fluid bed is then replaced by a fresh bed of reduced nickel oxide and the nickel then plated out to provide a product of substantially high purity, e.g., at least about 98% or higher, for example, over 99%.

The cobalt previously removed from solution together with some of the nickel may be sold as a secondary nickel-cobalt product, particularly for use in the production of alloys, e.g., superalloys.

Still another advantage of the fluid bed process of the invention is in the purifying of nickel leach solutions containing such impurities as Cu, Cd, and Zn. Such impurities can be removed very easily with the fluid bed process prior to recovering the nickel.

EXAMPLE 5

Impurity removal from synthetic sulfuric acid leach liquor was carried out using the fluidized cathode process provided by the invention. The results obtained in a typical test are summarized in Table 6. The current density was 2.22 $A/M^2$, the pH was maintained at 5 with $NH_4OH$, and the bed expansion was 11 percent. The fluidized bed was made up of 2500 grams of nickel-coated copper particles of 500 to 700 microns in size to simulate the surface of reduced nickel oxide.

TABLE 6

| Time | Ni (gpl) | Cu (ppm) | Cd (ppm) | Zn (ppm) |
|---|---|---|---|---|
| 0 | 66 | 73 | 16 | 12 |
| 15 | 66 | 13 | 16 | 9 |
| 30 | 66 | 10 | 16 | 7 |
| 45 | 66 | 8 | 10.5 | 5 |
| 60 | 64 | 6 | 0.7 | 4 |
| 90 | 64 | 3 | 0.6 | 1 |
| 120 | — | 3 | 0.6 | 1 |

These data indicate that Cu, Cd, and Zn can be reduced to very low levels in the feed solution without significantly lowering the nickel concentration.

Figure 9:
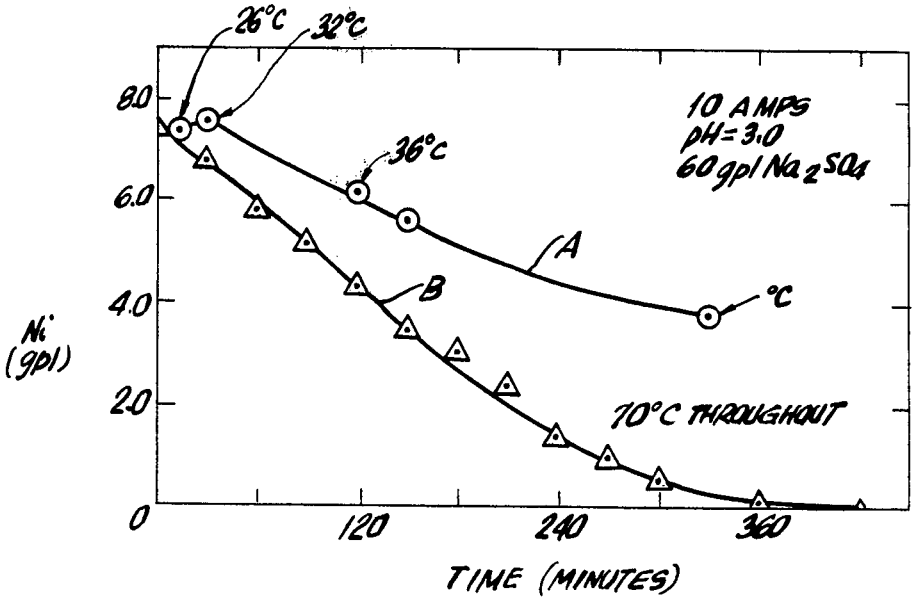
FIG. 9 illustrates the beneficial effect of increased temperature on the rate of nickel deposition.

FIG. 9 illustrates the beneficial effect of increased temperatures on the rate of nickel deposition from solution. As will appear from the figure, the top curve A shows the poor cell response when beginning the experiment at ambient temperature. It was only after the solution heated up due to resistance heating, for example, to 32° C., did the nickel reduction begin. However, by comparison, when the cell temperature was maintained at 70° C. (note lower curve B), relatively rapid plating the nickel resulted. Elevating the temperature accelerates the rate of nickel reduction and also decreases both the solubility of oxygen and also the magnitude of the oxygen limiting reduction current.

Thus, in plating out nickel, whether from an acid bath or from an ammoniacal bath, it is important that the temperature be above ambient, for example, over 25° C. It is preferred that the bath temperature be at least about 40° C. and range up to below the boiling point, e.g., 50° C. to 90%.

Figure 10:
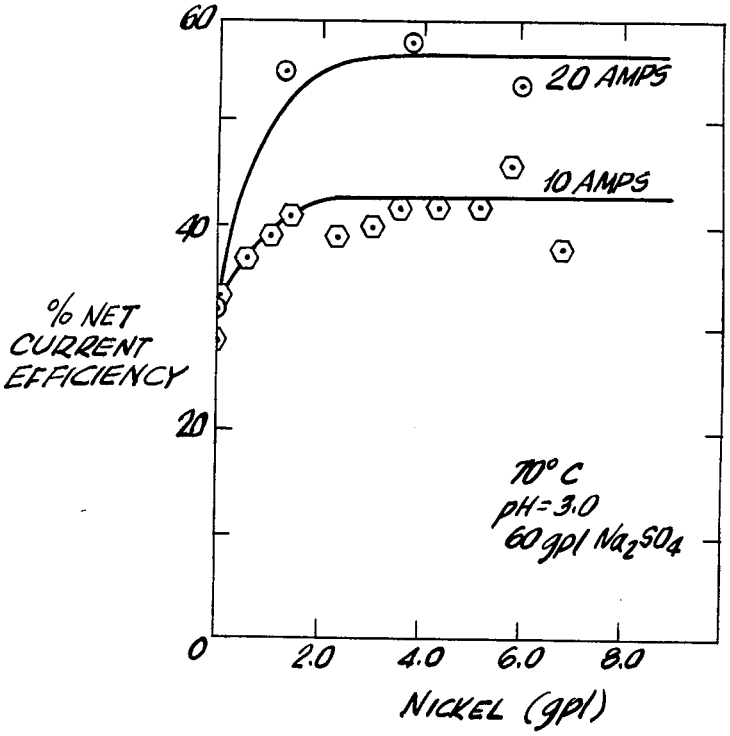
FIG. 10 depicts the effect of nickel concentration on the net current efficiency for nickel deposition from a simulated laterite leach solution.

The effect of nickel concentration on the net current efficiency for nickel deposition at 70° C. is shown in FIG. 10 for two current densities. The net current efficiency is that obtained from zero time to the time each sample is taken. The solution simulated a laterite leach solution.

As will be noted, the current efficiency is essentially constant during the early portion of each test and decreases when the critical nickel concentration is reached. This result appears to indicate that above the critical nickel concentration, nickel diffusion is not involved as a rate-controlling step. It is believed that either the cathode current (imposed) is not sufficient to sustain the convective-diffusion controlled reduction rate, or the rate of nickel deposition is kinetically controlled. The latter possibility appears to be substantiated by the temperature effects discussed hereinbefore.

Decreased current efficiency at low nickel concentrations indicates the presence of a convective-diffusion component in the rate determining step, since the thermodynamically unfavorable $Ni^{2+}/H^+$ ratio manifests itself as a reduced current efficiency. This effect is depicted by plotting the period current efficiency as a function of nickel concentration as shown in FIG. 11 for a simulated laterite leach solution.

Figure 11:
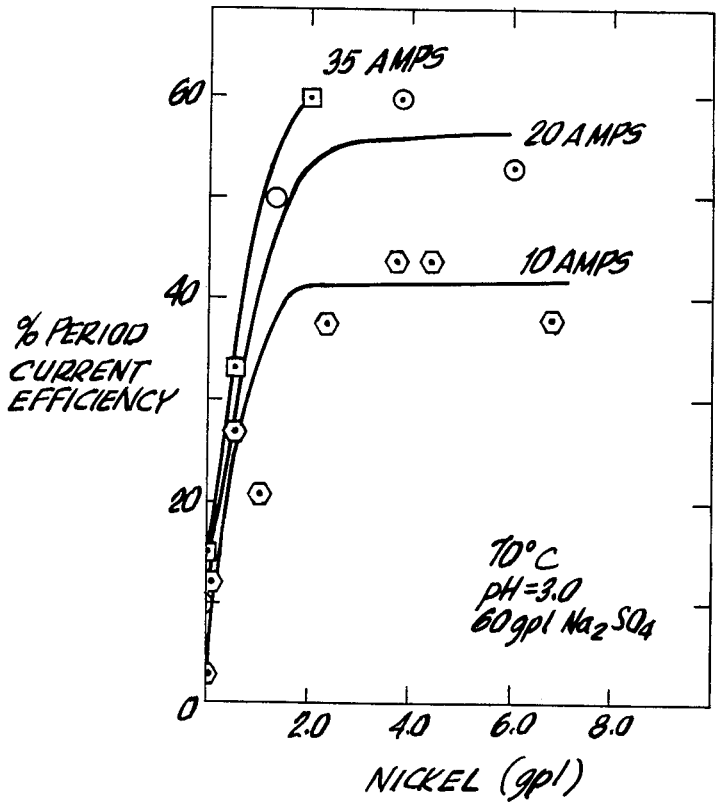
FIG. 11 shows the effect of nickel concentration on the period current efficiency for nickel deposition from a simulated laterite leach solution.

Both FIGS. 10 and 11 show that even at ppm levels of nickel, higher current densities yield higher current efficiencies.

Figure 12:
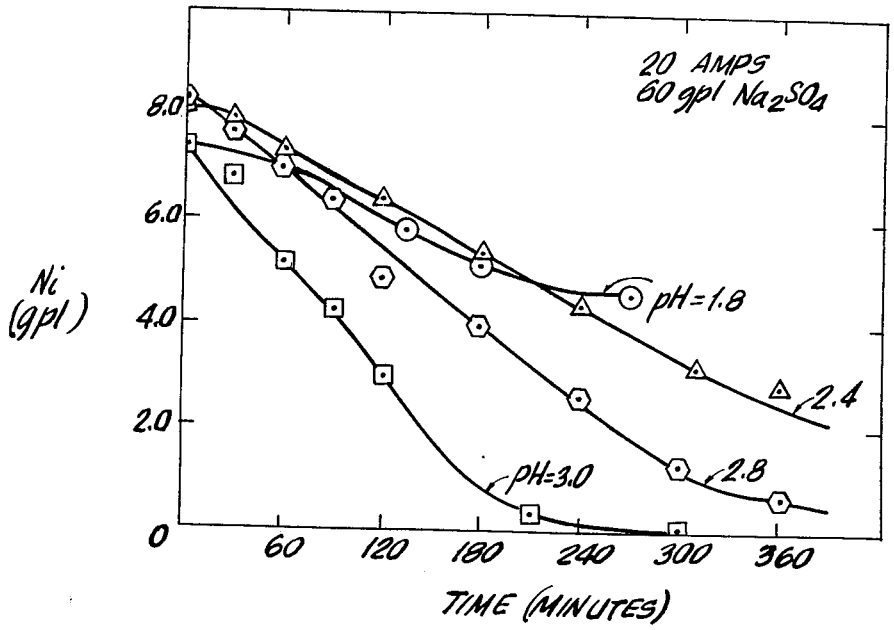
FIG. 12 illustrates the effect of pH on the rate of nickel deposition from a simulated laterite leach solution.

A major interfering cathode reaction that occurs in the system is the evolution of hydrogen. Therefore, the pH can play an important role in determining the current efficiency for nickel deposition. The data shown in FIG. 12 show that under otherwise identical conditions, decreasing pH decreases the linear current efficiency and increases the nickel concentration at which the current efficiency deviates from linearity. Linear current efficiency at a particular pH and nickel concentration is calculated by measuring the slope of the appropriate curve of FIG. 12 at the time in question.

Generally speaking, with regard to sulfuric acid leach solutions, the pH may range from about 2 to below the pH at which nickel hydrolyzes, e.g., from about 2.5 to 4.5.

It has been observed that the presence of trivalent chromium ions or other impurities can adversely affect the plating of nickel. To avoid this problem with laterite leach solutions, the pH can be increased to 5.0 with NaOH to hydrolyze the impurities (e.g., $Cr^{3+}$), the hydrolysis products then removed and the solution returned to pH 3.0 with $H_2SO_4$. Following this treatment, nickel will be successfully plated at 25 amps and 70° C. Nickel and cobalt concentrations have been reduced to 160 and 1 ppm, respectively, at 37% current efficiency as compared to 41% efficiency when using synthetic electrolytes containing only Ni, Co and Mg sulfates.

Figure 13:
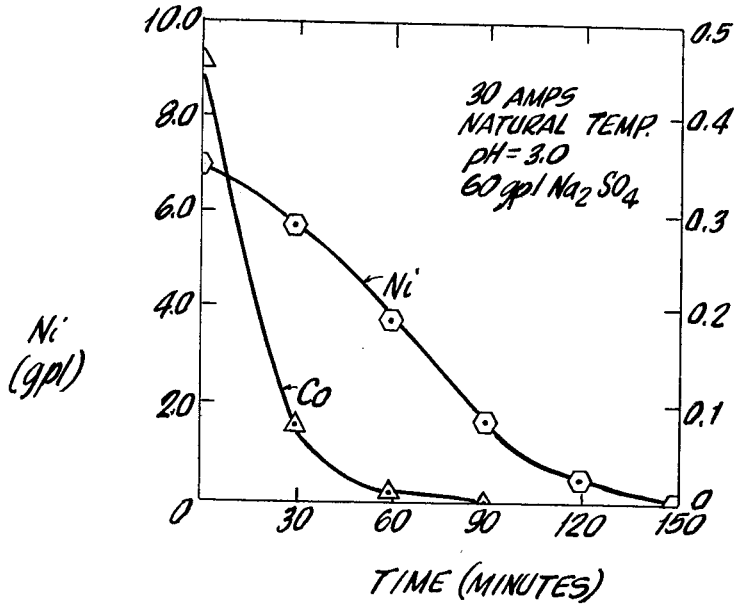
FIG. 13 depicts nickel/cobalt separation from a simulated laterite leach solution.

As stated hereinbefore, of particular interest is the preferential plating of cobalt observed during the tests. A simulated laterite feed liquor containing 0.5 gpl Co, 7 gpl Ni, 60 gpl $Na_2SO_4$ and having a pH of 3 showed a rather high selectivity for cobalt despite the low amounts of nickel as illustrated in FIG. 13. The selectivity is surprising in light of the near identical thermodynamic driving force for reduction of either $Ni^{2+}$ or $Co^{2+}$ to the metal.

Proper bed expansion is important in providing both maximum exposed particle surface area and interparticle contact. As particle contact is decreased, the net cell resistance increases and, under otherwise identical conditions, the cell voltage and bed polarization increase. Thus, as stated herein, it is important that the bed expansion relative to the static volume fall within the range of 5 to 20% and, more preferably, 8 to 15%.

Generally, speaking, laterite leach solutions may contain about 3 to 15 gpl and 0 to 2 gpl Co. Usually the nickel content ranges from about 5 to 10 gpl. The pH varies according to the amount of excess sulfuric acid remaining in solution following leaching. For electrolysis, the pH may range from 2 up to below the pH at which nickel hydrolyzes, e.g., 2.5 to 4.5. As will be appreciated, other salts may be present, such as sodium sulfate and/or magnesium sulfate.

Nickel solutions obtained in the high pressure leaching of nickeliferous sulfide materials may range in concentration from about 50 to 125 gpl, up to 10 gpl Co (e.g., 0.5 to 5 gpl Co). The pH may likewise range for electrolysis from about 2 to below hydrolysis pH for nickel and usually from about 2.5 to 4.5.

Since the pH tends to decrease during electrolysis, it is important that the pH be controlled over the foregoing ranges by the addition of a base, such as NaOH, or magnesium hydroxide or high magnesium laterites low in nickel.

Ammoniacal nickel solutions obtained in the ammonia leaching of nickel ore may likewise be treated by the process of the invention. Such solutions may likewise contain 50 to 125 gpl nickel together with ammonium sulfate. The pH of such solutions may range from about 7 to the solubility limit for the nickel ammonium complex salt, for example, at a pH ranging from about 7 to 10.

In operating the fluid bed cell, the amount of particulate material employed should be such to provide an expanded fluid bed uniformly disposed about the anode chamber and a surface area calculated to provide the desired cathode current density falling within the range of about 0.5 to 25 amps per square meter, e.g., 1 to 15.

The characteristics of each electrolyte can be easily determined by those skilled in the art as to pH requirements, current density, cell voltage, and the like.

In summary, the invention provides a process for extracting nickel from electrolytes in a fluid bed electrolysis cell. The process comprises establishing the nickel electrolyte bath in a fluid bed electrolysis cell containing an anode disposed axially in the cell within an anode chamber surrounded by a porous diaphragm. A cathode surrounds the anode chamber, the cathode defining an annular cathode chamber relative to said anode chamber containing a fluidizable cathode bed of nickel particles or pellets of at least about 95% purity (e.g., reduced nickel oxide pellets) ranging in size from about 150 microns to 2000 microns.

The process resides in maintaining a flow of electrolyte through the cell by passing the electrolyte axially through the cell beneath the fluidizable bed of nickel pellets at a rate to maintain the bed in a fluidized electro-chemically active cathodic state during which the cell is electrolytically activated to effect deposition of nickel from solution on the nickel pellets, the electrolysis being continued for a time sufficient to remove the nickel from the solution and provide a substantially high purity particulate nickel product.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A process for extracting nickel from electrolytes in a fluid bed electrolysis cell which comprises:

establishing said nickel electrolyte bath in a fluid bed electrolysis cell comprising, an anode disposed axially in said cell within an anode chamber surrounded by a porous diaphragm, a cathode surrounding the porous diaphragm of said anode chamber, said cathode defining an annular cathode chamber relative to said porous diaphragm and containing a fluidizable cathode bed of nickel pellets of at least about 95% purity ranging in size from about 150 microns to 2000 microns isolated from said anode chamber, maintaining a flow of said electrolyte through said cell by passing said electrolyte axially through said cell beneath said fluidizable cathode bed of nickel pellets at a rate to maintain said cathode bed in a substantially uniform fluidized electro-chemically active cathodic state at an expanded bed volume ranging from about 5% to 20% greater than its static volume, said electrolyte also passing through said anode chamber via said porous diaphragm, electrolytically activating said cell at a current density ranging from about 0.5 to 25 amps/sq. meter to effect deposition of nickel from said solution onto the surface of said nickel pellets during which gas bubbles are formed by electrolysis, causing said flow of electrolyte leaving said cell to collect in a reservoir to permit disengagement and removal of said gas bubbles from said electrolyte, recycling said electrolyte from said reservoir to said cell and through said anode and cathode chambers, and continuing said electrolysis for a time sufficient to remove the nickel from said solution and provide a substantially high purity particulate nickel product containing at least about 95% nickel.

2. The process of claim 1, wherein the temperature is controlled above 25° C. and up to below the boiling point.

3. The process of claim 2, wherein the fluidized bed volume ranges from about 8% to 15% greater than the static bed volume.

4. The process of claim 1, wherein said nickel electrolyte is an acid electrolyte in which the pH is controlled over the range of about 2 to less than the pH at which nickel hydrolyzes.

5. The process of claim 4, wherein the pH ranges from about 2.5 to 4.5.

6. The process of claim 1, wherein the bed consists essentially of reduced nickel oxide pellets of average size ranging from about 300 to 1500 microns and contains at least about 98% nickel and wherein the temperature is controlled over the range of about 50° C. to 90° C.

7. The process of claim 1, wherein the nickel electrolyte is an ammoniacal solution having a pH ranging from about 7 to the solubility limit of the nickel ammonium complex salt.

8. A continuous process for extracting nickel from electrolytes in a fluid bed electrolysis cell which comprises:

establishing said nickel electrolyte bath in a fluid bed electrolysis cell comprising, an anode disposed axially in said cell within an anode chamber surrounded by a porous diaphragm, a cathode surrounding the porous diaphragm of said anode chamber, said cathode defining an annular cathode chamber relative to said porous diaphragm and containing a fluidizable cathode bed consisting essentially of reduced nickel oxide pellets containing at least about 95% nickel and ranging in size from about 150 microns to 2000 microns, maintaining a continuous flow of said electrolyte through said cell by passing said electrolyte axially through said cell beneath said fluidizable cathode bed and through the cathode and anode chambers at a rate to maintain said cathode bed in a substantially uniform fluidized electro-chemically active cathodic state at an expanded bed volume ranging from about 5% to 20% greater than the static bed volume while electrolytically activating said cell at a current density ranging from about 0.5 to 25 amps/sq. meter to effect deposition of nickel on the surface of said reduced nickel oxide pellets during which gas bubbles are formed by electrolysis, said electrolyte also passing through said anode chamber via said porous diaphragm, causing said flow of electrolyte leaving said cell to collect in a reservoir to permit disengagement and removal of said bubbles from said electrolyte, continuously withdrawing the electrolyte from said reservoir and recycling it to the cathode and anode chambers through said fluidized cathode bed, continuously monitoring and controlling the pH of the electrolyte at a predetermined value according to the nickel solution being treated, and continuing said electrolysis for a time sufficient to remove nickel from said solution and provide a substantially high purity particulate nickel product containing at least about 95% nickel.

9. The process of claim 8, wherein the reduced nickel pellets have an average size ranging from about 300 to 1500 microns and contains at least about 98% nickel, and wherein the temperature is over 25° C. and ranges up to below the boiling point.

10. The process of claim 9, wherein the nickel electrolyte is an acid electrolyte in which the pH is controlled over the range of about 2 to less than the pH at which nickel hydrolyzes, and wherein the temperature ranges from about 50° C. to 90° C.

11. The process of claim 10, wherein the pH of the solution is controlled over the range of about 2.5 to 4.5.

12. The process of claim 9, wherein the nickel electrolyte is an ammoniacal solution having a pH ranging from about 7 to the solubility limit of the nickel ammonium complex salt.

13. The process of claim 12, wherein the temperature ranges from about 50° C. to 90° C.

14. The continuous process of claim 8, wherein the fluidized bed volume ranges from about 8% to 15% greater than the static bed volume.

15. A continuous process for extracting nickel from electrolytes in a fluid bed electrolysis cell which comprises:

establishing said nickel electrolyte bath in a fluid bed electrolysis cell comprising, an anode disposed axially in said cell within an anode chamber surrounded by a porous diaphragm having an exposed area ranging from about 5% to 30% of the total area of the diaphragm, a cathode surrounding the porous diaphragm of said anode chamber, said cathode defining an annular cathode chamber relative to the porous diaphragm of said anode chamber containing a fluidizable cathode bed consisting essentially of reduced nickel oxide pellets containing at least about 95% nickel and ranging in size from about 150 microns to 2000 microns, maintaining a continuous flow of said electrolyte through said cell by passing said electrolyte axially through said cell beneath said fluidizable cathode bed and through the cathode and anode chambers at a rate to maintain said bed in a substantially uniform fluidized electro-chemically active cathodic state at an expanded bed volume ranging from about 5% to 20% greater than the static volume of said bed, while electrolytically activating said cell to effect deposition of nickel on the surface of the reduced nickel oxide pellets at a current density ranging from about 0.5 to 25 amps/sq. meter during which gas bubbles are formed by electrolysis, said electrolyte also passing through said anode chamber via said porous diaphragm, continuously withdrawing the electrolyte from said cell, collecting said withdrawn electrolyte during said flow through said electrolysis cell in a basin or reservoir to permit disengagement and removal of said gas bubbles formed during electrolysis, recycling said electrolyte from said basin or reservoir to said cell and through said anode and cathode chambers, continuously monitoring and controlling the pH of the electrolyte at a predetermined value according to the nickel solution being treated, and continuing said electrolysis for a time sufficient to remove nickel from said solution and provide a substantially high purity particulate nickel product containing at least about 95% of nickel.

16. The process of claim 15, wherein the reduced nickel pellets have an average size ranging from about 300 to 1500 microns and contains at least about 98% nickel, and wherein the temperature is over 25° C. and ranges up to below the boiling point.

17. The process of claim 16, wherein the nickel electrolyte is an acid electrolyte in which the pH is controlled over the range of about 2 to less than the pH at which nickel hydrolyzes, and wherein the temperature ranges from about 50° C. to 90° C.

18. The process of claim 17, wherein the pH of solution is controlled over the range of about 2.5 to 4.5.

19. The process of claim 16, wherein the nickel electrolyte is an ammoniacal solution having a pH ranging from about 7 to the solubility limit of the nickel ammonium complex salt.

20. The process of claim 19, wherein the temperature ranges from about 50° C. to 90° C.

21. The continuous process of claim 15, wherein the fluidized bed volume ranges from about 8% to 15% greater than the static bed volume.

* * * * *